United States Patent [19]

Hermanns et al.

[11] 4,274,076

[45] Jun. 16, 1981

[54] DEVICE FOR DETERMINING THE MOMENT WHEN COMPETITORS IN A RACE ARE PASSING THE FINISH LINE

[75] Inventors: Winfried Hermanns, Lutticherstr. 181, D-5100, Aachen, Fed. Rep. of Germany; Heinz Lueg, Aachen, Fed. Rep. of Germany; Hanno Blackert, Aachen, Fed. Rep. of Germany; Dirk Wimmenauer, Aachen, Fed. Rep. of Germany

[73] Assignee: Winfried Hermanns, Aachen, Fed. Rep. of Germany

[21] Appl. No.: 133,839

[22] Filed: Mar. 25, 1980

[30] Foreign Application Priority Data

Apr. 7, 1979 [DE] Fed. Rep. of Germany ..... 2914114

[51] Int. Cl.[3] ..... G08C 21/00

[52] U.S. Cl. ..... 340/38 L; 340/23; 340/32; 340/323 R

[58] Field of Search ..... 340/31 R, 32, 23, 38 L, 340/323 R, 309.4, 39; 235/92 T, 92 TA, 92 TC, 92 GA; 368/113; 272/4, 5; 273/86 R; 455/99; 343/7 VM

[56] References Cited

U.S. PATENT DOCUMENTS

| | | | |
|---|---|---|---|
| 3,546,696 | 12/1970 | Waters et al. | 340/323 R |
| 3,795,907 | 3/1974 | Edwards | 340/323 R |
| 3,825,889 | 7/1974 | Koerner | 340/38 L |
| 3,946,312 | 3/1976 | Oswald et al. | 340/323 R |
| 4,074,117 | 2/1978 | De Lorean et al. | 340/323 R |

*Primary Examiner*—James J. Groody

*Attorney, Agent, or Firm*—Spensley, Horn, Jubas & Lubitz

[57] ABSTRACT

In this system for determining the moment when competitors in a race pass the finish line, each competitor is fitted with a transmitter. Arranged at the finish line are at least two receiving antennas, the signals from which are combined in opposite sense so as to form a difference signal. A system output signal then is produced which has a leading edge that occurs when the difference signal crosses zero. This output signal indicates that a competitor has passed the finish line.

8 Claims, 4 Drawing Figures

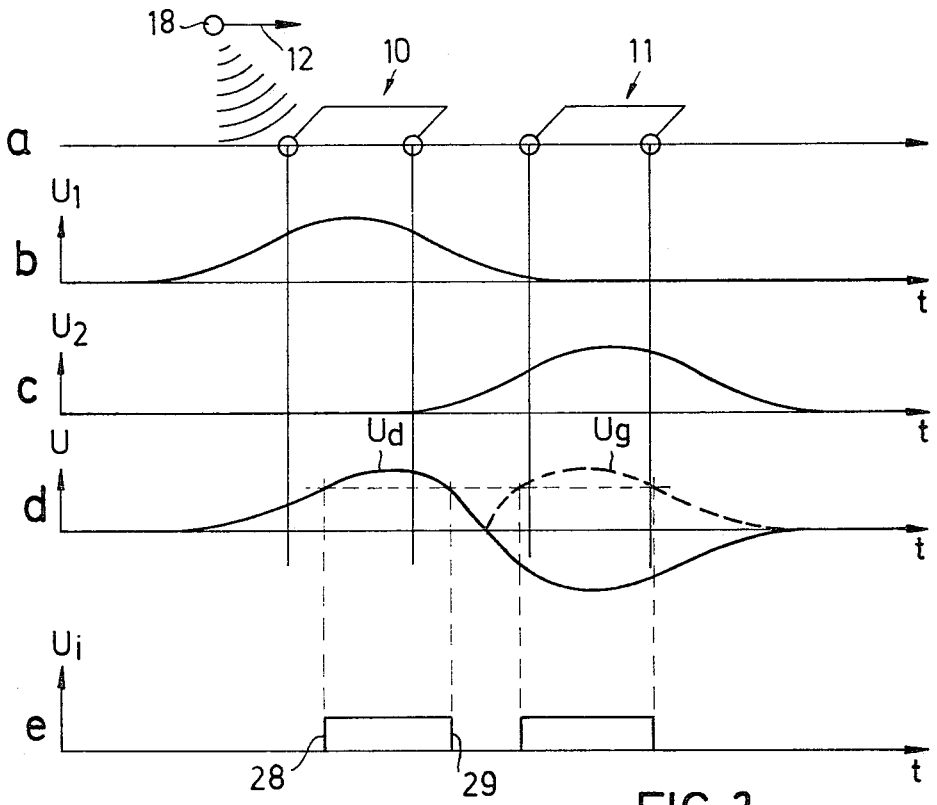
FIG. 3
FIG. 2
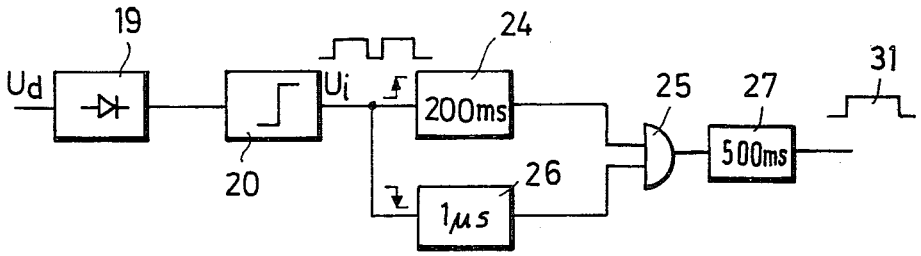

DEVICE FOR DETERMINING THE MOMENT WHEN COMPETITORS IN A RACE ARE PASSING THE FINISH LINE

BACKGROUND OF THE INVENTION

1. Field of the Invention

The invention relates to a device for determining the moment when competitors in a race are passing the finishing line.

2. Description of the Prior Art

Due to the methods of electronic timing, a very accurate determination of competition times is possible. What is critical, however, in many cases, is the exact determination of the moment when the finishing line is passed. This is so, above all, when several competitors are participating at the same time in a race, for instn. in a car race. It may happen that several competitors are passing the finishing line within a short distance of each other in an overlapping manner so that it cannot be readily determined which moment of passing the finishing line should be attributed to which competitor. While, after all, the accurate moment can be determined by a photo-finish, the evaluation always takes some time. Alternatively, the use of a light barrier extending along the finishing line only gives an information about the passing of the first competitor in case of a nearly simultaneous passing of several competitors. If light barriers are mounted vertically to the racing course, a bridge at the end of the racing course must be erected. In car races, such a bridge is a danger for the competitors and it gives an obstruction of visibility for the spectators. Moreover, it is a disadvantage of light barriers that the light transmitters and light receives may become dirty and that manipulations and interferences can be expected from third parties.

It is the object of the invention to provide a device of the type mentioned at the outset hereof which permits an exact determination of the moment when competitors in a race are passing the finishing line even if the finishing line is passed nearly at the same time, interferences and manipulations by third parties being practically excluded.

SUMMARY OF THE INVENTION

To solve this problem, it is provided, according to the invention that the competitors are fitted with transmitters which transmit selective characteristics, that at the finish, at least two receiving antennae are arranged consecutively in the direction of the racing course and connected to receivers which are tuned selectively to the characteristics of the transmitters and that an evaluating device is connected downstream of each receiver and determines the transmission of the signals from the first to the second receiving antenna to supply a corresponding signal representing the moment when a competitor passes the finishing line.

Each transmitter and receiver are assigned selectively to one particular competitor, so that it can be exactly determined when he passes the finishing line. When the finishing line is passed, the transmitter of the corresponding competitor first reaches the receiving area of the first receiving antenna and subsequently, it is covered by the receiving area of the second receiving antenna. The determination and evaluation of the transmission permits to exclude the effects of homogenous electromagnetic fields because such homogeneous fields simultaneously excite both receiving anteannae with the same intensity so that no transmission can be recorded. Stationary interfering transmitters or transmitting devices in the vicinity of the racing course cannot produce signals as to the passing of the finishing line even if they are provided with the characteristics of the corresponding competitors. As a result, a high degree of absolute reliability is obtained. The characterization may be effected for inst. by a selectivity of frequency in that the transmitters of the competitors emit different frequencies while the receivers connected to the receiving antennae are selectively tuned to one of the transmitted frequencies. Other types of characterization are possible alternatively. For inst. all transmitters may operate on one frequency only which, however, is modulated with another frequency for each transmitter. Thus, only one sole receiver is required which delivers frequency signals to selective evaluating devices. Alternatively, different pulse clock rates of one sole transmitted frequency are also possible for each receiver.

It is preferred that the receiving antennae are induction loops which are embedded in the ground. They can be flatly embedded and do not form obstacles in the finishing area. In car races, the transmitters can be mounted at the bottom plates of the vehicles or in a hole of the bottom plates. To this effect, the transmitters are spaced only slightly from the roadway, while they are protected on top by the bottom plate or by the car body. Due to the small distance from the ground a reduced transmitting power will do. The ground acts as a swamp for the emitted radiation which cannot cause radio interferences accordingly. The distance between the two induction loops should be in the order of the distance between the ground and the transmitters. In view of the small road clearance of racing cars the receiving antennae or induction loops are closely side by side so that a very accurate determination concerning the passing of the finishing line is possible as required for the high speed of racing cars.

The receiving antennae are preferably coupled with each other in opposite direction for the difference formation of their signals. Upon approaching of a transmitter, a positive signal is for inst. generated in the first receiving antenna whose voltage amplitude will decrease again upon passing by the first receiving antenna to subsequently go through zero. When, thereafter, the receiver is passing the second antenna, it will create a negative voltage at the second antenna. The zero passage of the total signal of both receiving antennae can be determined very accurately by electronic means.

A device for the rectification of the difference signal of the two receiving antennae may be provided to determine the zero passage. The rectified difference signal is supplied via a pulse former stage to the differentiating device, which selects one of the two pulse edges generated near the zero passage of the difference signal to generate the resulting signal for the passing of the finishing line. One optionally may select the leading or the trailing pulse edge to determine the zero passage. Both pulse edges being very closely side by side, the decision concerning the pulse edge selected for the evaluation will not have any influence on the accuracy of the measuring result.

To avoid simulating of passing of a finishing line by interference pulses, the pulse former stage may be connected to a time member having a receiving time which is longer than the duration of the rectified difference signals and of the antennae. The output of the time member is supplied to one input and the output of the differentiating device is supplied to the other input of an AND-circuit. This, it is ensured that the signal of the differentiating device is only evaluated if the time member has been put into operation by the excitation of the first receiving antenna.

The induction loops may be fitted closely side by side to comprise a common central wire, so that only three wires are necessary for realising two induction loops.

For the coupling in opposite direction, the induction loops can be connected to primary coils of a transformer which are wound in opposite winding directions.

BRIEF DESCRIPTION OF THE DRAWINGS

With reference to the Figures, some embodiments of the invention will be explained hereinafter.

FIG. 2 shows a block diagram of an evaluating device according to FIG. 1, FIG. 3 shows different signal curves at the receiving antennae and in the evaluating device and FIG. 4 is another embodiment of the coupling of the receiving antennae.

DESCRIPTION OF THE PREFERRED EMBODIMENTS

Figure 1:
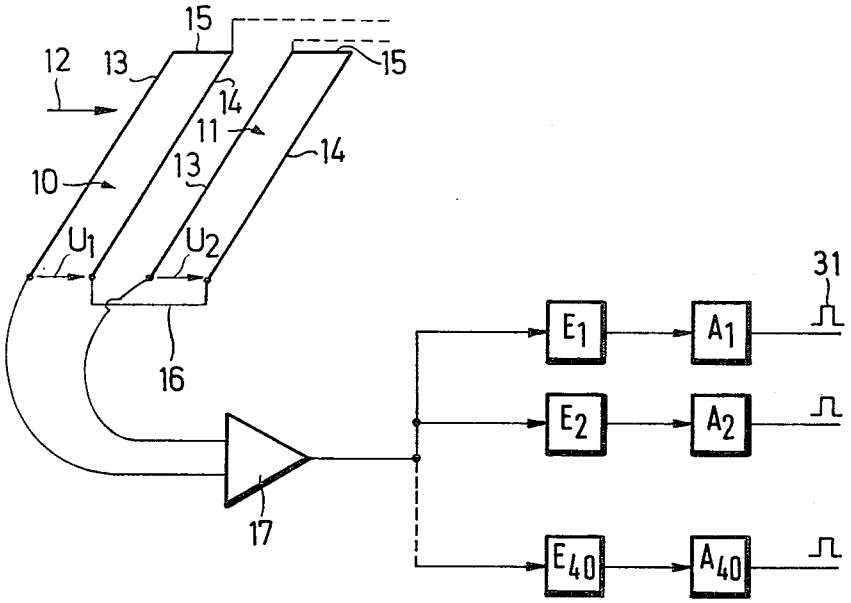
FIG. 1 is a schematic illustration of a first embodiment of a device provided at the finishing line of a car racing course.

According to FIG. 1, two induction loops 10 and 11 are embedded in the ground of a racing course at the finishing line. The driving direction of the cars is marked with arrow 12. The induction coils comprise each two wires 13, 14 extending in parallel across the racing course and being interconnected at one end by a connecting wire 15. The wires 13 and 14 are in one (horizontal) plane. With respect to the wires 14, the wires 13 of the induction coils 10 and 11 are provided ahead in driving direction. The free ends of the wires 14 are interconnected by a connecting wire 16 so that the induction coils 10 and 11 are connected in an opposite sense. The free ends of wires 13 are connected to the input terminals of an amplifier 17. The output of the amplifier 17 is connected to a great number of selective receivers $E_1$ to $E_{40}$. Each of the receivers is tuned to the transmitter frequency of one of the frequency-selective transmitters (not illustrated) mounted at the racing cars. Said tuning is realised in the known manner with quartz-controlled oscillators. To avoid standing waves at the induction loops 10,11, the wave length should be large as compared to the width of the racing course.

If a racing car provided with a transmitter 18 is passing the induction loops 10, 11 in direction of arrow 12, there is formed at the free ends of the induction loop 10 the time curve of a voltage $U_1$ as shown in FIG. 3*b*.

At the free ends of the induction loop 11, there is formed the time curve of voltage $U_2$ as illustrated in FIG. 3*c*. The voltages $U_1$ and $U_2$ increase with an approach of the transmitter 18 and they reach their peak point when the transmitter 18 is in the center of the corresponding induction loop. Subsequently, they decrease again.

Since the induction loop 11 is poled inversely with respect to the induction loop 10, the voltage curve $U_d$ as shown in FIG. 3*d* is formed at the input of the amplifier 17, which curve corresponds to the difference between voltages $U_1$ and $U_2$.

In the evaluating units $A_1 \ldots A_{40}$ connected at the outlet side of the receivers $E_1 \ldots E_{40}$ the voltage curves $U_d$ of the individual receivers are processed. FIG. 2 shows a block diagram of one of the evaluating units.

The positive portion of signal $U_d$ is supplied via a two-phase rectifier 19 to a pulse former stage 20, acting as a threshold circuit, i.e. it generates an output signal "0," when the input signal is below a threshold value and an output signal "1" when its input signal is above a threshold value. The signal at the output of the two-phase rectifier is designated as $U_g$ in FIG. 3*d*. Its amplitude values are only positive.

At the output of the pulse former stage 20, there is formed the pulse signal $U_i$ illustrated in FIG. 3*e*. It consists of two longer pulses which are separated by a pulse gap. In the center of the pulse gap, there is a zero passage of signal $U_d$.

The output signal of the pulse former stage 20 is supplied to two time members 24 and 26, which may consist of monostable flip-flops. Time member 24 responds to the positive pulse edge of signal $U_i$ and has a running time of 200 ms. The time member 26 responds to the negative pulse edges of signal $U_i$ and has a running time of 1 μs. The outputs of the two time members 24 and 26 are combined in an AND circuit 25, whose output signal is supplied to a third time member 27 having a running time of 500 ms. At the output of the time member 27, there is formed the pulse 31 pertaining to the passing of the finishing line and its rising edge is marking the moment when the finishing line is passed. The time member 24 is made operative by the rising edge 28 of the voltage $U_i$. The AND-circuit 25 is enabled by the time member 26 which is put into action by the trailing edge of voltage $U_i$. This is the moment which is taken for the passing of the finishing line.

Figure 4:
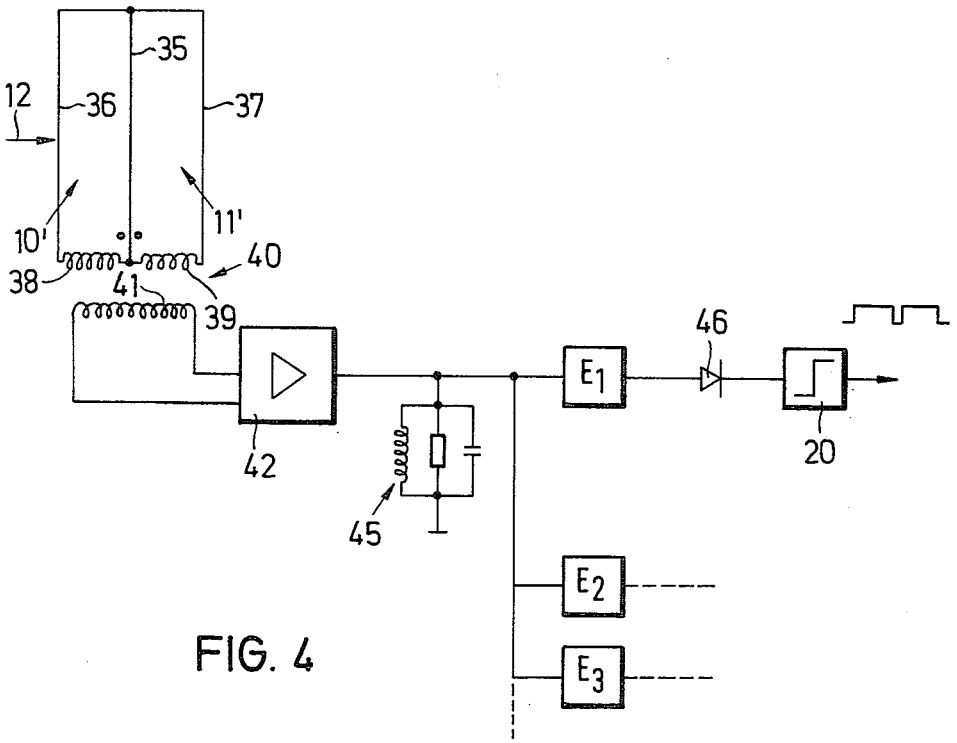

In FIG. 4, another embodiment is shown in which the two induction loops 10' and 11' are also provided transversely relative to the driving direction 12, but they have one common central conductor 35. The ends of the first induction loop 10' consisting of the conductors 35 and 36 are connected to a first primary winding 38 of a transformer 40. The conductors 35 and 37 of the second induction loop 11' are connected to the second primary winding 39 of the transformer 40. The beginnings of the two primary windings 38 and 39 are dotted in FIG. 4. As evident, the two primary windings 38 and 39 are wound in opposite directions. Thus, the difference formation of the signals of the two induction loops 10' and 11' is achieved so that the curve of the difference signal as illustrated in FIG. 3*d* is formed.

The secondary winding 41 is connected to the input of the amplifier 42.

A band pass 45 connected to the output of the amplifier 42 allows only the frequencies of the interesting range of frequency of the receiver $E_1 \ldots E_{40}$ to pass.

The individual selective receivers $E_1 \ldots E_{40}$ are connected to the band pass. A diode 46 is connected at the outlet side of each receiver and the pulse former stage 20 is connected to said diode. The circuit behind the pulse former stage 20 corresponds to the circuitry shown in FIG. 2. The difference formation of the signals of the receiving antennae and the rectification by the transformer are shown in the embodiment of FIG. 4.

Circumstances arising, it might be suitable to provide a second group of receivers and to connect them e.g. to the transverse wires 15 according to FIG. 1. As a result, the protection against interferences by external transmitters is increased additionally. The distribution of the electromagnetic field or its change in time due to the movement of the transmitter is measured by the difference formation of the two antennae. Stationary transmitters cannot influence the device accordingly and cannot cause it to respond.

We claim:

1. A system for determining the moment when competitors in a race pass the finish line, in which race the competitors are each fitted with a transmitter, said system comprising:

at least two receiving antennae arranged at the finish line, the signals from said antennae being combined and supplied to an evaluating equipment comprising:

means for coupling said signals from said antennae in opposite sense to form a difference signal therebetween, a rectifier receiving said difference signal, and an output signal circuit connected to said rectifier and responsive to a voltage change of the rectified difference signal for generating a system output signal indicating that a competitor has passed the finish line.

2. A system according to claim 1 wherein said output signal circuit comprises:

a pulse former stage connected to said rectifier circuit and producing an output when said rectifier difference signal exceeds a certain threshold, the output of said pulse former stage thereby comprising a pair of rectangular wave signals corresponding respectively to the signals from said antennae, and a pulse producing element, connected to said pulse former stage, and responsive to one of the two pulse edges of said pair of rectangular wave signals which occur near the zero passage of said difference signal, the output of said pulse producing element being a signal which begins at the time of passing of said finish line.

3. A system according to claim 2 further comprising:

a timer also connected to the output of said pulse former stage and having an operative time beginning at the start of the first of said pair of rectangular wave signals and which is longer than the time duration of the rectified difference signal, and signal combining means for providing said system output signal only upon the occurrence of an output of said pulse producing element during the operative time of said timer.

4. A system according to claim 1 wherein each of said receiving antennae comprises a separate induction loop embedded in the ground, said at least two loops having a common central wire.

5. A system according to claim 1 wherein said at least two receiving antennae are connected to oppositely wound primary coils of a transformer, the output of said transformer being coupled to said rectifier.

6. A system according to claim 1 wherein each competitor's transmitter has a uniquely different transmitted signal characteristic, there being a plurality of like evaluation equipments, together with receiver means, connected to said antennae, for providing to each respective evaluation equipment the signals induced by a corresponding respective one of said transmitters.

7. A system for determining the moment when competitors in a race pass the finish line, each competitor being fitted with a transmitter, said system comprising:

at least two receiving antennas arranged at the finish line, each competitor's transmitter inducing signals in said antennas as the competitor passes the finish line, difference signal formation means for combining the resultant signals from said antennas in opposite sense to form a difference signal therebetween, and output signal means, connected to said signal formation means, for producing an output signal which begins when said difference signal crosses zero, said output signal indicating that said competitor has passed the finish line.

8. A system according to claim 7 wherein said output signal means comprises:

a rectifier circuit for rectifying said difference signal, a threshold circuit providing an output when said rectified difference signal exceeds a certain threshold value, said threshold circuit output thereby comprising a pair of rectangular wave signals wherein the trailing edge of the first and the leading edge of the second of said pair occur respectively just before and just after the zero crossing of said difference signal, and output pulse forming means, connected to said threshold circuit, for forming a single rectangular wave output signal which begins in unison with said trailing edge of the first or said leading edge of the second of said pair of rectangular wave signals.

* * * * *